US009848657B2

(12) United States Patent
Urban

(10) Patent No.: US 9,848,657 B2
(45) Date of Patent: Dec. 26, 2017

(54) SOCKS WITH PAIRING AND HOLDING FEATURE

(76) Inventor: Martin A. Urban, Belvidere, IL (US)

( * ) Notice: Subject to any disclaimer, the term of this patent is extended or adjusted under 35 U.S.C. 154(b) by 52 days.

(21) Appl. No.: 13/417,768

(22) Filed: Mar. 12, 2012

(65) Prior Publication Data

US 2013/0232665 A1 Sep. 12, 2013

(51) Int. Cl.
*A41B 11/00* (2006.01)

(52) U.S. Cl.
CPC ..... *A41B 11/002* (2013.01)

(58) Field of Classification Search
CPC ..... A41B 11/002
USPC ..... 2/239
See application file for complete search history.

(56) References Cited

U.S. PATENT DOCUMENTS 4,150,498 A * 4/1979 Palmer ..... 36/10
4,939,823 A 7/1990 Klein
5,044,051 A 9/1991 Klein
5,579,541 A 12/1996 Christy et al.
2005/0086726 A1* 4/2005 Poole ..... 2/239
2006/0096007 A1* 5/2006 Burstein ..... 2/239
2007/0256280 A1 11/2007 Azan
2010/0011486 A1 1/2010 Allen
2010/0088804 A1* 4/2010 Crosby ..... 2/239
2011/0209268 A1 9/2011 Smitherman
2012/0167276 A1* 7/2012 Brosie et al. ..... 2/239

* cited by examiner

*Primary Examiner* — Katherine Moran
(74) *Attorney, Agent, or Firm* — Conley Rose, P.C.; William H. Dietrich

(57) ABSTRACT

A pair of socks is provided. The first sock defines a first toe end and a first upper end. The first sock includes an elastically deformable first aperture formed through the first sock proximate the first upper end. The second sock defines a second toe end and a second upper end. The second sock includes an elastically deformable second aperture formed through the second sock proximate the second upper end. When the first toe end of the first sock is drawn through the second aperture of the second sock and the second toe end of the second sock is drawn through the first aperture of the first sock the first and second socks are secured together.

4 Claims, 3 Drawing Sheets

SOCKS WITH PAIRING AND HOLDING FEATURE

BACKGROUND

Pairs of socks tend to become separated when, for example, placed in a load of wash along with other articles of clothing. The time spent sorting through multiple pairs of socks to find matching pairs after doing the load of laundry is wasteful and frustrating. Moreover, when one sock is lost or temporarily misplaced, the remaining sock is unusable without its match.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

Figure 1:
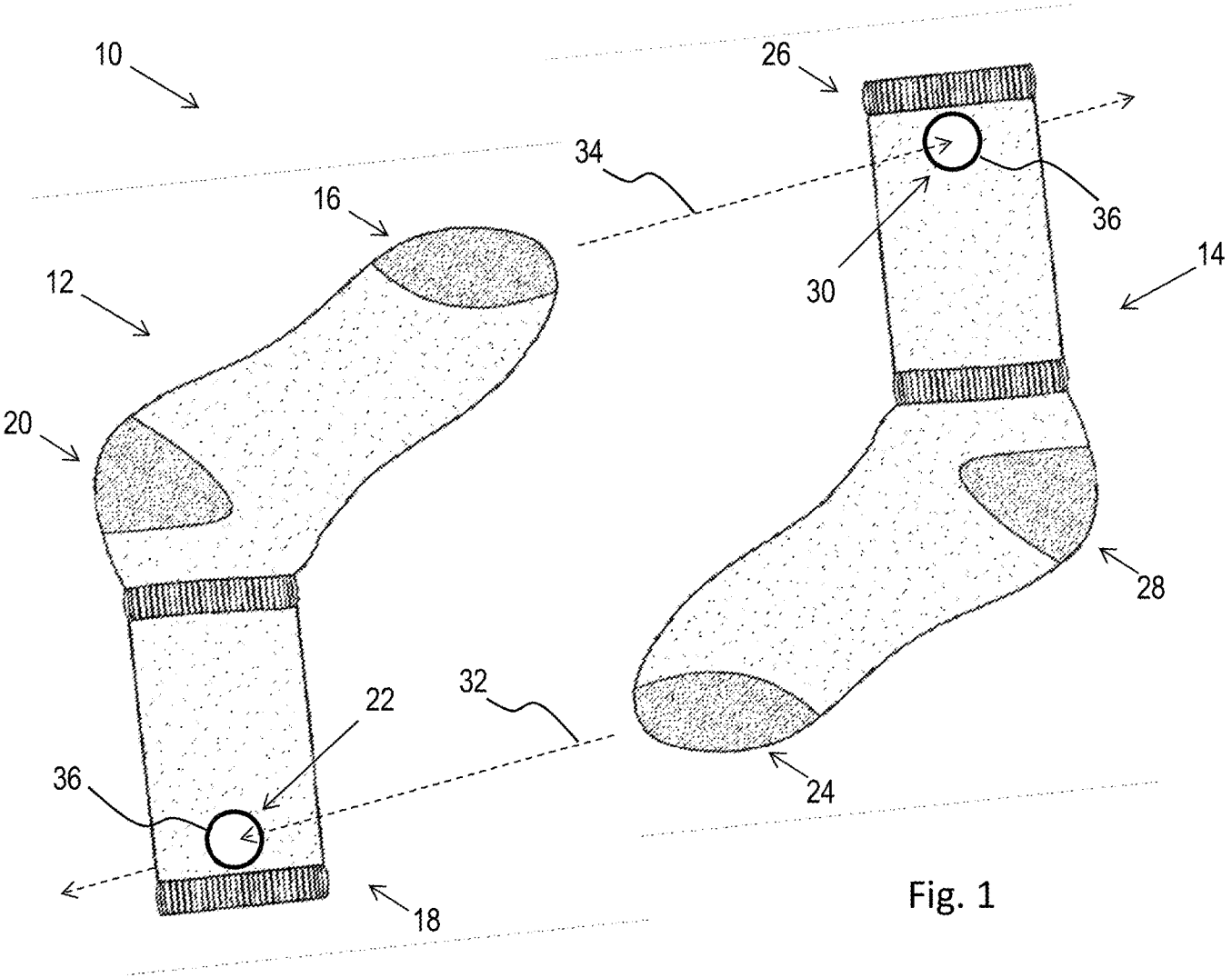
FIG. 1 is a plan view of an embodiment of a pair of socks having a pairing and holding feature.

As will be more fully explained below, the present disclosure relates to a pair of socks 10 having a pairing and holding feature. Therefore, the pair of socks 10 may be conveniently laundered and stored without one of the socks in the pair becoming temporarily misplaced or lost. As shown in FIG. 1, the pair of socks 10 generally includes a first sock 12 and a second sock 14.

The first sock 12 defines a toe end 16 and an upper end 18 (e.g., the cuff or a portion of the leg body) with a heel portion 20 generally disposed therebetween. The first sock 12 includes an elastically deformable aperture 22 formed through the first sock 12 proximate the upper end 18. Similar to the first sock 12, the second sock 14 defines a toe end 24 and an upper end 26 with a heel portion 28 generally disposed therebetween. The second sock 14 includes an elastically deformable aperture 30 formed through the second sock 14 proximate the upper end 26.

The elastically deformable aperture 22 in the upper end 18 of the first sock 12 is generally configured to receive and temporarily secure the toe end 24 of the second sock 14 as depicted by arrow 32 in FIG. 1. Likewise, the elastically deformable aperture 30 in the upper end 26 of the second sock 14 is generally configured to receive and temporarily secure the toe end 16 of the first sock 12 as depicted by arrow 34 in FIG. 1.

In an embodiment, the elastically deformable apertures 22, 30 are each formed with an elastic material such as, for example, a strip of elastic 36 that has been stitched or sewn around the apertures 22, 30. The elastic material may completely encircle or only partially surround the apertures 22, 30 passing through the first and second socks 12, 14. In an embodiment, the elastically deformable apertures 22, 30 are each formed using a wash resistant material capable of withstanding numerous cycles of laundering.

Figure 2B:
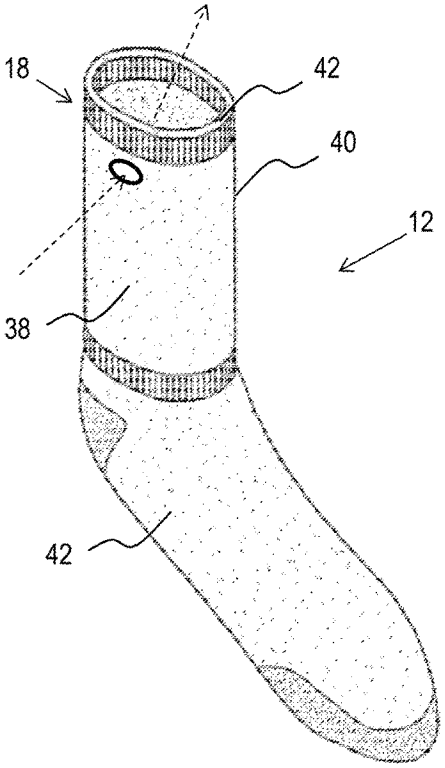
FIG. 2*b* is a perspective view of another embodiment of one of the socks from FIG. 1.
Figure 2A:
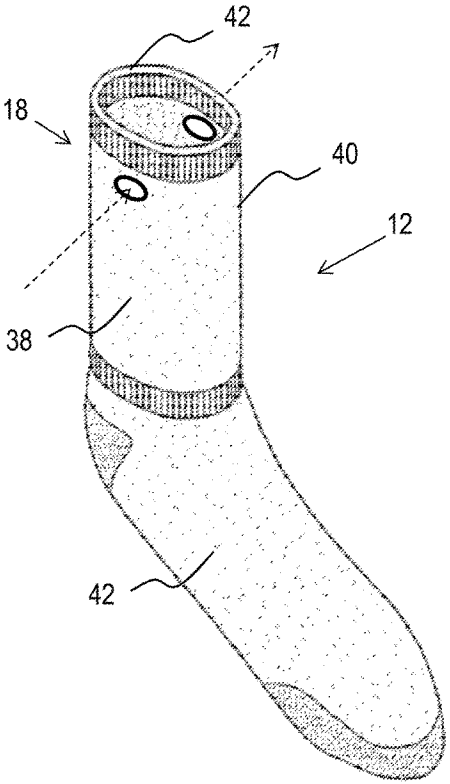
FIG. 2*a* is a perspective view of an embodiment of one of the socks from FIG. 1.

In an embodiment, the elastically deformable aperture 22 is formed through opposing sides 38, 40 of the first sock 12 as shown in FIG. 2*a*. In other words, the elastically deformable aperture 22 passes through both layers of sock material 42 proximate the upper end 18. In another embodiment, the elastically deformable aperture 22 is only formed through a single side or layer of the sock material 42 as shown in FIG. 2*b*. In an embodiment, the elastically deformable aperture 30 may also be formed through opposing sides 38, 40 of the second sock 14 or through only a single layer of the sock material. In an embodiment, the elastically deformable apertures 22, 30 are formed by stitching or sewing elastic material inside each of the socks 12, 14 proximate the apertures 22, 30 such that the elastic material is not readily visible when the socks are worn.

Each of the first and second socks 12, 14 of FIG. 1 may be formed from a wide variety of materials 42. Some of these materials 42 include, but are not limited to, cotton, wool, nylon, acrylic, polyester, olefins (such as polypropylene), or spandex. To get an increased level of softness, other materials may be also used such as, for example, silk, bamboo, linen, cashmere, or mohair. The material 42 of the socks 12, 14 may be plain white or can include or incorporate a wide variety of colors. The socks 12, 14 may also bear designs or incorporate artistic elements.

The socks 12, 14 may be manufactured in a variety of lengths. For example, the socks 12, 14 may be typical tube or dress socks, bare or ankle socks that extend to the ankle or lower and are often worn casually or for athletic use, toe socks for use with flip-flops or sandals, knee-high socks, and the like. In addition, the socks 12, 14 may be specifically sized and dimensioned to fit men, women, boys, girls, teens, toddlers, and infants.

Figure 3:
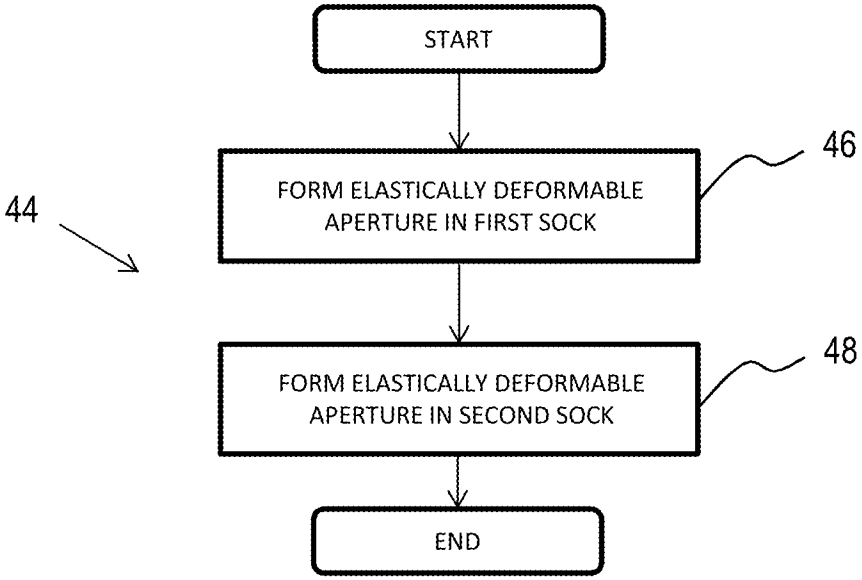
FIG. 3 is a method of forming the pair of socks of FIG. 1.

Referring now to FIG. 3, a method 44 of forming a pair of socks 10 is illustrated. In block 46, an elastically deformable aperture 22 is formed in an upper end 18 of the first sock 12. In block 48, an elastically deformable aperture 30 is formed in an upper end 26 of the second sock 14. In an embodiment, the first and second socks 12, 14 may thereafter be packaged together and sold as the pair of socks 10 illustrated in FIG. 1.

As noted above, the elastically deformable apertures 22, 30 are arranged such that when the toe end 16 of the first sock 12 is drawn through the elastically deformable aperture 30 of the second sock 14 and the toe end 24 of the second sock 14 is drawn through the elastically deformable aperture 22 of the first sock 12 the pair of socks 10 may be secured together. In other words, the elastically deformable apertures 22, 30 are collectively configured to releasably secure the pair of socks 10.

In an embodiment, only one of the socks in the pair of socks 10 (i.e., either the first sock 12 or the second sock 14) includes an elastically deformable aperture (e.g., either aperture 22 in the first sock 12 or aperture 30 in the second sock). In such an embodiment, a portion of the sock without any elastically deformable aperture is drawn through the elastic aperture of the other sock. Also, in an embodiment a portion of the first sock 12 and the second sock 14 other than the toe ends 16, 24 may be drawn through the elastically deformable apertures 22, 30.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A pair of socks, comprising:

a first sock defining a first toe end and a first upper end;

a second sock defining a second toe end and a second upper end;

an elastically deformable aperture formed only through the first sock and not the second sock of the pair of socks such that when the second sock is drawn through the elastically deformable aperture of the first sock, the second sock is secured to the first sock;

wherein the first sock and the second sock each define an interior surface opposing an exterior surface, the interior surface oriented to contact a wearer's foot when the first sock and the second sock are worn;

wherein the elastically deformable aperture is formed using elastic material, the elastic material overlying the interior surface and hidden from view by the exterior surface when the first sock and the second sock are worn, and wherein the elastically deformable aperture is formed through opposing sides of the first sock.

2. The pair of socks of claim 1, wherein the elastically deformable aperture is formed by elastic material completely encircling the elastically deformable aperture.

3. The pair of socks of claim 1, wherein the elastically deformable aperture is formed using a wash resistant material.

4. The pair of socks of claim 1, wherein the elastic material comprises a strip of elastic stitched into the first sock.

* * * * *